US011174635B1

(12) United States Patent
Monier et al.

(10) Patent No.: US 11,174,635 B1
(45) Date of Patent: Nov. 16, 2021

(54) BAFFLE CEILING TILE WITH RETAINING STRUCTURE

(71) Applicant: FACT Design, LLC, Davis, CA (US)

(72) Inventors: Daniel Monier, Atlanta, GA (US); Troy S. Jones, Sweetwater, TN (US); Ernest Lansford, III, Sweetwater, TN (US)

(73) Assignee: FACT Design, LLC, Davis, CA (US)

( * ) Notice: Subject to any disclaimer, the term of this patent is extended or adjusted under 35 U.S.C. 154(b) by 0 days.

(21) Appl. No.: 17/244,081

(22) Filed: Apr. 29, 2021

(51) Int. Cl.
*E04B 9/04* (2006.01)

(52) U.S. Cl.
CPC ..... *E04B 9/0414* (2013.01)

(58) Field of Classification Search
CPC ..... E04B 2009/062; E04B 9/22; E04B 9/225; E04B 9/242; E04B 9/241; E04B 9/24; E04B 9/245; E04B 9/247; E04B 9/28; E04B 9/06; E04B 9/061; E04B 9/04; E04B 9/0414; E04B 9/0435
USPC ..... 52/581, 582.1, 586.2, 585.1
See application file for complete search history.

(56) References Cited

U.S. PATENT DOCUMENTS 1,845,080 A 2/1932 Eyring et al.
2,392,551 A * 1/1946 Roe ..... E04B 2/08 52/586.2
2,871,598 A * 2/1959 Pawelka ..... G09F 13/00 40/561
2,882,990 A * 4/1959 Mustoe ..... G10K 11/16 181/284
2,928,197 A * 3/1960 Zuckerman ..... G09F 13/00 40/561
3,055,469 A * 9/1962 Byssing ..... E04B 9/16 52/506.09
3,321,877 A 5/1967 Alexieff
3,343,309 A 9/1967 Norman et al.
(Continued)

FOREIGN PATENT DOCUMENTS

FR 3088352 A1 5/2020
WO 2020095163 A1 5/2020

OTHER PUBLICATIONS

U.S. Appl. No. 17/181,340, filed Feb. 22, 2021, Daniel Monier, Entire document.

(Continued)

*Primary Examiner* — Jessica L Laux
(74) *Attorney, Agent, or Firm* — United IP Counselors, LLC

(57) ABSTRACT

A baffle tile that folds from a flat configuration into a three-dimensional configuration is disclosed. In the three-dimensional configuration, it includes a rim portion and a baffle portion. The rim portion is split into halves. Each half of the rim portion terminates in a pair of upwardly-folded, spaced-apart tabs. When the baffle tile is in its three-dimensional configuration, each tab meets and abuts its counterpart from the other half of the rim portion. Each tab has a notch in it, arranged such that the notches of abutted tabs are aligned. A retaining structure inserts into each set of aligned notches. The retaining structures prevent the tabs of the baffle tile from separating. In some cases, a single retaining structure that has approximately the same size as the baffle tile itself may also serve as a cap to enclose the tile.

19 Claims, 8 Drawing Sheets

(56) References Cited

U.S. PATENT DOCUMENTS 3,348,459 A * 10/1967 Harvey ..... E01C 9/083 404/35
3,404,498 A 10/1968 Espinoza
3,466,830 A * 9/1969 Ving ..... E04B 9/003 52/777
3,548,735 A 12/1970 Sweeney et al.
3,640,039 A * 2/1972 McKee ..... F16B 5/0052 52/281
3,685,235 A 8/1972 Lang
3,835,614 A 9/1974 Downing
4,290,218 A * 9/1981 Drueck, Jr. ..... G09F 13/0436 40/553
4,330,046 A 5/1982 Lerner et al.
4,672,780 A 6/1987 Lockwood
4,776,139 A * 10/1988 Lockwood ..... E04B 1/3211 29/432.1
4,947,570 A * 8/1990 May ..... G09F 13/0436 40/553
D338,241 S * 8/1993 Landa ..... D20/43
5,274,938 A * 1/1994 McDonald ..... G09F 7/22 40/617
5,282,331 A * 2/1994 Fell ..... G09F 7/22 362/223
D373,831 S 9/1996 Lechleiter et al.
5,993,283 A * 11/1999 Cyrus ..... A63H 33/04 446/108
D431,839 S * 10/2000 McCaffrey, Jr. ..... D20/10
6,189,282 B1 * 2/2001 VanderWerf ..... E04B 2/14 52/582.1
6,467,209 B1 * 10/2002 Vickers ..... F21V 1/22 40/617
6,622,579 B1 9/2003 Muth et al.
6,640,513 B2 * 11/2003 Ku ..... B44C 3/12 404/40
6,851,211 B2 * 2/2005 Sender ..... G09F 7/22 40/431
7,334,852 B2 * 2/2008 Marihugh ..... A47B 81/06 312/245
8,327,591 B2 12/2012 Wilkinson, Jr. et al.
8,438,893 B2 * 5/2013 Durney ..... B21D 51/52 72/324
8,782,987 B2 7/2014 Kabatsi et al.
9,038,326 B2 5/2015 Bergman et al.
9,487,952 B2 11/2016 Nilsson et al.
9,765,519 B2 9/2017 Bergman
9,989,204 B2 * 6/2018 Howe ..... F21V 17/108
10,006,619 B1 6/2018 Niemiec et al.
10,145,104 B1 * 12/2018 Winn ..... E04B 9/065
10,288,238 B2 * 5/2019 Yaphe ..... E04B 9/006
10,359,163 B1 7/2019 Hettwer et al.
10,508,444 B2 * 12/2019 Gillette ..... E04B 9/045
10,662,647 B2 * 5/2020 Kilian ..... E04B 9/0414
10,975,568 B1 * 4/2021 Monier ..... E04B 1/99
2003/0163967 A1 * 9/2003 Sims ..... E04B 2/7424 52/586.2
2004/0250494 A1 * 12/2004 Osiatinskiy ..... A63H 33/101 52/582.1
2006/0016145 A1 1/2006 Lonneman
2009/0241460 A1 * 10/2009 Beaulieu ..... E04B 1/6129 52/586.2
2011/0146183 A1 * 6/2011 Wilkens ..... E04B 9/045 52/506.06
2015/0121772 A1 * 5/2015 Berken ..... E04B 1/34331 52/28
2018/0180052 A1 6/2018 Niemiec et al.
2018/0363295 A1 12/2018 Gillette
2019/0113219 A1 4/2019 Niemiec et al.
2020/0002942 A1 * 1/2020 Headley ..... E04B 9/0407

OTHER PUBLICATIONS

Sullivan, C. C., & Horwitz-Bennett, B. (Feb. 2013). "New Trends in Ceiling Designs and Materials." Ceiling Systems AIA Continuing Education.

* cited by examiner

BAFFLE CEILING TILE WITH RETAINING STRUCTURE

TECHNICAL FIELD

The invention relates to ceiling tiles for drop ceilings, and in particular, to ceiling tiles with integrated baffles.

BACKGROUND

U.S. Pat. No. 10,975,568 discloses ceiling tiles for drop ceilings that fold into a three-dimensional configuration that includes a downwardly-extending baffle. These tiles are initially flat and are folded into their three-dimensional configuration. Tabs on each side of the tile can be folded upwardly and connected together to hold the tile in its three-dimensional configuration.

The patent suggests that external fasteners, like screws, can be used to connect the tabs together. Adhesives are given as an option. Other options, like small neodymium magnets, may also be used in some cases. Each of these options has serious disadvantages. For example, external fasteners, like screws, require the installer to carry extra tools, and may be inconvenient to use. Magnets require rare earth minerals that are difficult to obtain and come at increasingly high cost. Adhesives pose environmental problems whenever they are used in manufacturing, and in recent years, industry has moved away from the use of adhesives whenever possible.

All of the external fastener options described above also pose problems if the tiles are recycled or re-used. The polyethylene terephthalate (PET) felt used for most modern tiles is one of the plastics most often reused and recycled, as it is the same basic material used for many types of beverage bottles, among other things. Screws, magnets, and adhesive films may make it more difficult to reuse or recycle the tiles, because all of them must be removed before reuse or recycling.

BRIEF SUMMARY

One aspect of the invention relates to a baffle tile. The baffle tile folds from a flat configuration into a three-dimensional configuration. In the three-dimensional configuration, it includes a rim portion and a baffle portion. When the baffle tile is placed in the grid of a drop ceiling, the baffle portion extends downwardly. Because of the folding that creates the three-dimensional configuration, the rim portion is split into halves. Each half of the rim portion terminates in a pair of upwardly-folded, spaced-apart tabs. When the baffle tile is in its three-dimensional configuration, each tab meets and abuts its counterpart from the other half of the rim portion. Each tab has a notch in it, arranged such that the notches of abutted tabs are aligned. A retaining structure inserts into each set of aligned notches. The retaining structure has a first portion that fits within the notches and second portions at each end of the first portion that are larger than the notches. The retaining structures prevent the baffle tile from separating in the plane of the rim portion. The retaining structures may be made from the same material as the baffle tile itself, e.g., by cutting.

The tabs and the retaining structures may be arranged to reduce visibility of those components from below.

In some cases, a single retaining structure may be used. The single retaining structure has openings positioned to insert over both pairs of abutted tabs, and a size and shape that are substantially the same as the shape of the baffle tile in plan view. This single retaining structure may insert over the top side of the baffle tile, above the rim, and serve the additional purpose of closing any openings that are created in the tile by the folding down of the baffle or baffles.

Typically, the arrangement of the baffle tile and its retaining structure or structures is such that the retaining structure or structures can be installed in the baffle tile without tools.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
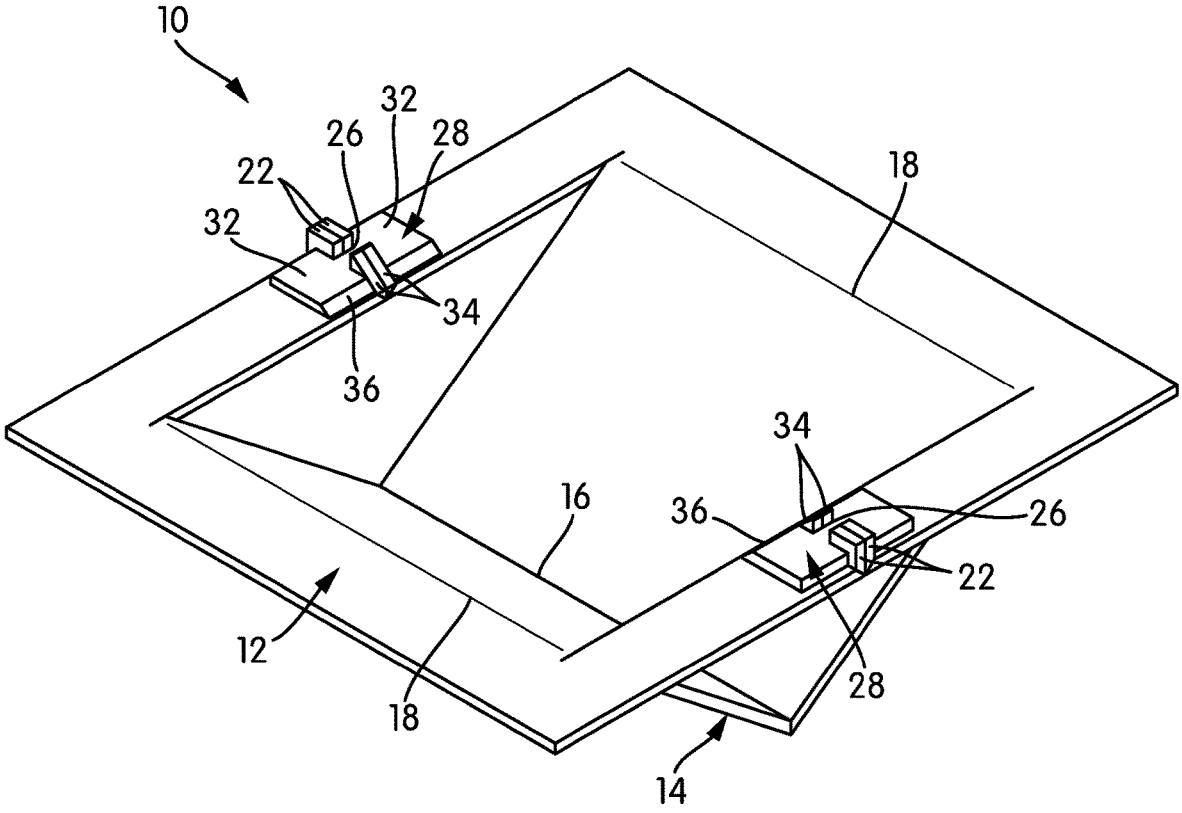
FIG. 1 is a perspective view of a baffle tile with fastening structure according to one embodiment of the present invention.

FIG. 1 is a perspective view of a baffle tile, generally indicated at 10, according to one embodiment of the invention. The baffle tile 10 has the same basic configuration as the baffle tiles described in U.S. Pat. No. 10,975,568, the contents of which are incorporated by reference in their entirety. In the three-dimensional configuration shown in FIG. 1, the baffle tile 10 has a rim 12 that is generally flat and extends around the perimeter of the baffle tile 10. The rim 12 has the size and shape needed to allow the baffle tile 10 to sit within the grid of a drop ceiling. Typically, the underside of the rim 12 would be supported by the grid. The baffle tile 10 also has a depending baffle portion 14.

The baffle tile 10 is typically provided in a flat initial configuration and is folded into the three-dimensional configuration shown in FIG. 1. The flat initial configuration, which is shown in the perspective view of FIG. 2, allows the baffle tile 10 to be shipped flat, thereby reducing packaging and transportation costs. The baffle tile 10 is typically folded into the three-dimensional configuration shown in FIG. 1 by an installer.

Figure 2:
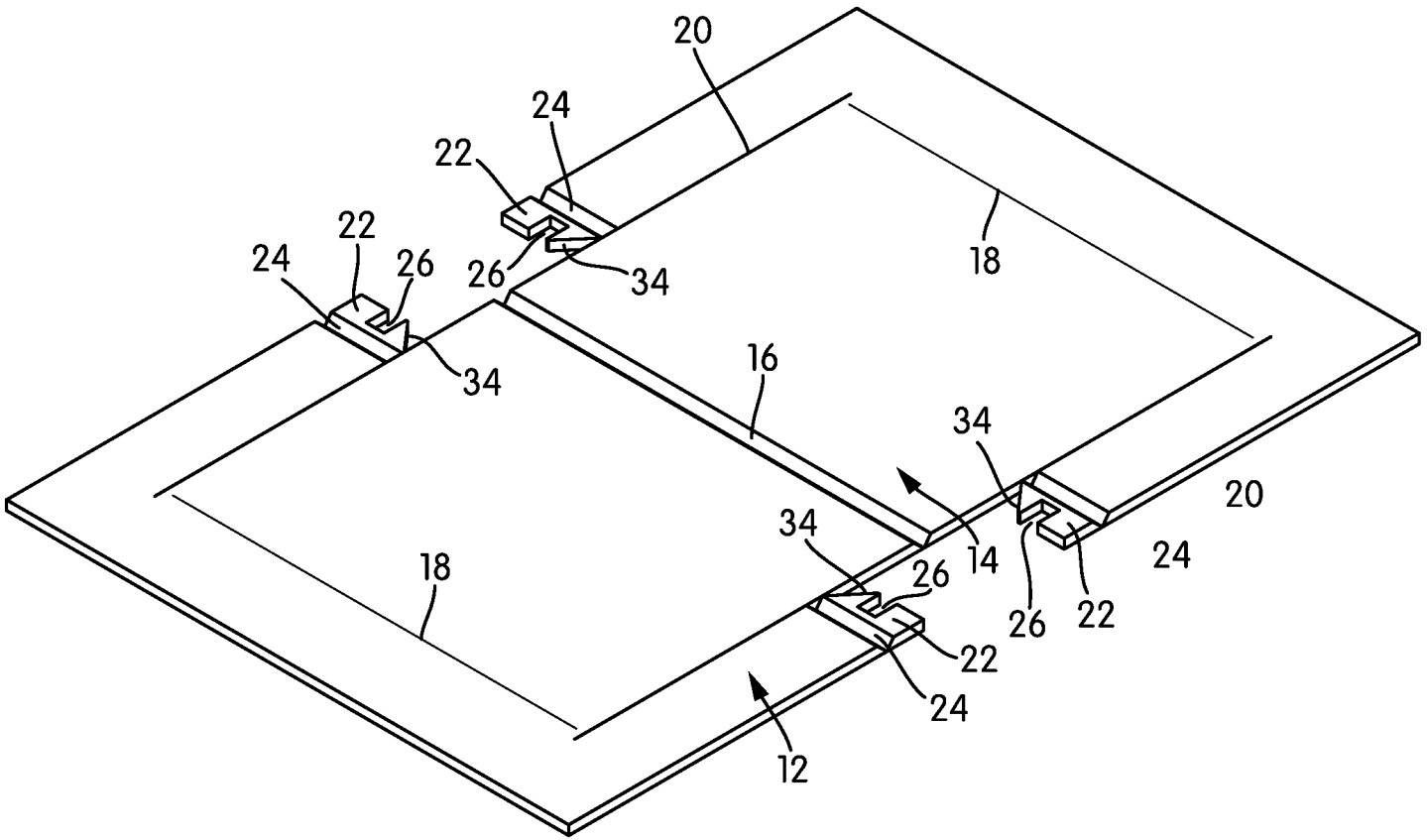
FIG. 2 is an exploded perspective view of the baffle tile and fastening structure of FIG. 1.

More specifically, as can be seen in FIG. 2, the baffle tile 10 of the illustrated embodiment has a central fold line 16 along its transverse centerline that defines the apex of the generally triangular baffle portion 14, and a fold line 18 spaced longitudinally and symmetrically to each side of the central fold line 16. The fold lines 16, 18 are usually V-cuts in the material of the baffle tile 10, either on its upper or lower surface, depending on the intended direction of the fold. As shown in FIG. 2, the central fold line 16 is a V-cut on the upper surface of the baffle tile 10, while the fold lines 18 that are spaced to either side of it are formed on the lower surface of the baffle tile 10. In addition to fold lines 16, 18, cut lines 20 parallel to and on both sides of the longitudinal axis of the baffle tile 10 separate the rim 12 from the baffle portion 14.

The configuration shown in FIGS. 1 and 2 of the baffle tile 10 and its baffle portion 14 may differ from embodiment to embodiment. As U.S. Pat. No. 10,975,568 illustrates and describes, the baffle portion 14 may have many different configurations. Additionally, as set forth in U.S. patent application Ser. No. 17/181,340, filed Feb. 22, 2021, there may be several separate baffle portions in any one baffle tile 10. (The contents of U.S. patent application Ser. No. 17/181,340 are incorporated by reference herein in their entirety.)

Once the baffle tile 10 is folded into the three-dimensional configuration shown in FIG. 1, it is desirable to keep it in that configuration. Lateral forces exerted by the grid of a drop ceiling may help to keep the baffle tile in its folded, three-dimensional configuration. However, the baffle tile 10 itself has structure designed to keep it in its three-dimensional configuration.

As shown in FIG. 2, the rim 12 is split at and around the transverse centerline of the baffle tile 10, i.e., around the position of the central fold line 16 in this embodiment. A pair of tabs 22 is defined in each side of the rim 12, one tab 22 on each side of the transverse centerline, for a total of four tabs 22. The tabs 22 are defined in part by same the longitudinal cut lines 20 that define and separate the baffle portion 14 from the rim 12, and in part by a small, V-cut fold line 24 that separates each tab 22 from the rest of the rim 12 and allows each tab 22 to fold up.

As shown in FIG. 1, when the baffle tile 10 is folded into its three-dimensional configuration, the pairs of tabs 22 that oppose each other across the transverse centerline of the baffle tile 10 abut. In fact, the size and proportions of the tabs 22, and their extent relative to the transverse centerline of the baffle tile 10, dictate, at least in part, the geometry of the baffle portion 14. For example, if the tabs 22 extend to the transverse centerline of the baffle tile 10, the baffle portion 14 will extend straight downward, rather than forming a triangle.

In the illustrated embodiment, the opposing pairs of tabs 22 are bound together in a new way. Each tab 22 has a rectangular notch 26 cut into it in the longitudinal direction of the baffle tile 10, as shown in FIGS. 1 and 2. When the baffle tile 10 is in the three-dimensional configuration of FIG. 1, the notches 26 from the opposed pairs of tabs 22 are aligned and oriented vertically. A retaining structure 28 is inserted into each aligned set of notches 26. The retaining structure 28 keeps the tabs 22 together and thus joins the split-halves of the rim 12.

Figure 3:
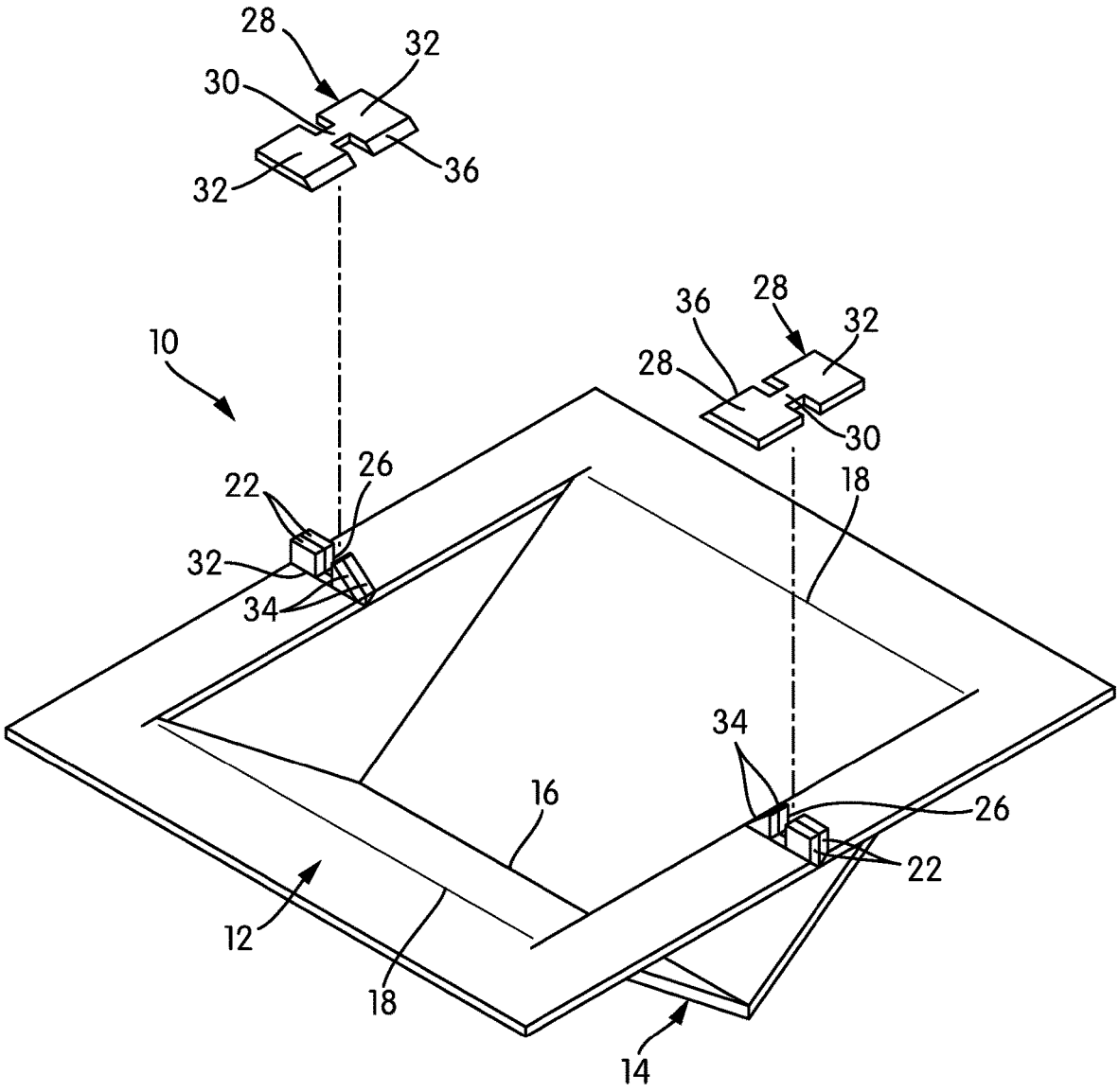
FIG. 3 is a perspective view of the baffle tile of FIG. 1 in its flat configuration.

The retaining structure 28 can be best seen in the exploded perspective view of FIG. 3. Each retaining structure 28 has a narrow neck 30 sized to fit tightly within the aligned notches 26 of the two tabs 22. On each side, the neck broadens into a wide rectangular section 32. The two rectangular sections 32 of the retaining structure 28 have the same or almost the same width as the rim 12 and tabs 22 in this embodiment. As can be seen in FIG. 1, once a retaining structure 28 is seated with the neck 30 in the aligned notches 26 of the tabs 22, the tabs 22 cannot move apart and the baffle tile 10 is thus held in its three-dimensional configuration.

The notches 26 are not limited to a rectangular shape, and may have any shape, so long as that shape is complementary to the shape of the retaining structure 28. Thus, for purposes of this description, the term "notch" is defined broadly to mean any engaging feature that is cut into the tile material and is capable of engaging a retaining structure. However, the rectangular shape of the notches 26 in the illustrated embodiment may be the simplest shape that will perform the necessary functions, and that has advantages in that fewer cuts need be made to the sheet of tile material. Moreover, for the sake of simplicity, while means by which the notches 26 and the retaining structure 28 engage may be different or more complex in other embodiments, it is advantageous if the retaining structures 28 can be seated in the notches 26 by manual pressure without the use of tools.

In the illustrated embodiment, the tabs 22 have another feature: an angled surface 34 is cut on each tab 22, facing inward. The retaining structure 28 has a bevel 36 cut at the same angle on its inwardly-facing side. The angled surfaces 34 and bevel 36 cant the tabs 22 and the retaining structure 28 away from the inner edge of the rim 12. This, in turn, may improve sightlines, preventing the structures 22, 28 from being seen from below when the baffle tile 10 is installed in the grid of a drop ceiling.

The baffle tile 10 may be made of any number of materials, as may conventional ceiling tiles, but in most modern embodiments, the baffle tile 10 is made of a polyethylene terephthalate (PET) felt. While the retaining structure 28 may also be made of essentially any material, including metals, woods, and plastics, it is most advantageously made of the same material as the baffle tile 10—usually PET felt. The retaining structure 28 may also have the same thickness as a typical tile—9 mm (0.35 in). This means that the retaining structure 28 can be cut from the same material as the baffle tile 10, using the same equipment and processes. In fact, in at least some cases, the retaining structure may be fashioned from the material removed from a two-foot by four-foot section of PET felt to form the tabs 22. If the retaining structure 28 is formed from material cut out of a sheet of PET felt to make the tile 10, the tile 10 can be manufactured with very little waste material.

Figure 4:
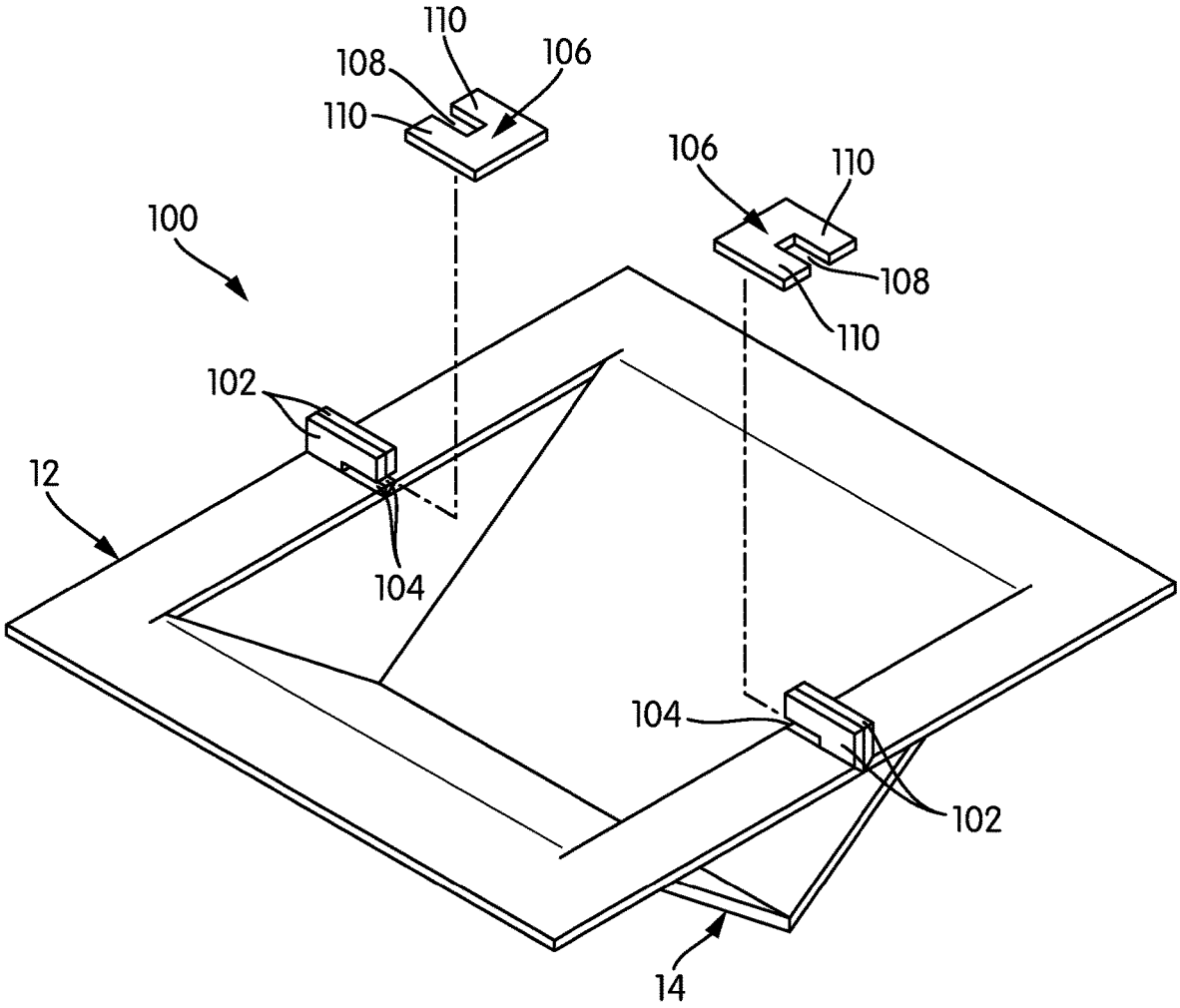
FIG. 4 is an exploded perspective view of a baffle tile according to another embodiment of the invention.

The baffle tile 10 and its retaining structure 28 are not the only possible configuration of a baffle tile according to embodiments of the invention. FIG. 4 is an exploded perspective view of a tile, generally indicated at 100, according to another embodiment of the invention. The baffle tile 100 has a rim 12 and a baffle portion 14 that are generally identical to those shown and described above with respect to the baffle tile 10 of FIGS. 1-3, although as was also noted above, this need not be the case in all embodiments. The baffle tile 100 may have multiple baffle portions, or baffle portions with different proportions, for example.

The main difference between the baffle tile 10 and the baffle tile 100 lies in the tabs 102. Instead of the vertically-oriented notches 26 that extend down from a top surface, the tabs 102 have notches or slots 104 that open along the lower inner lateral edges of the tabs 102 and extend laterally inward, terminating roughly at the vertical centerline of each tab 102. As in the previous embodiment, the slots 104 of opposed tabs 102 are aligned.

The retaining structures 106 of this embodiment are C- or U-shaped, including a rectangular notch 108 that opens along one side of a square or rectangular body. The retaining structures 106 are also flat and, like the retaining structures 28 described above, may be cut from the same material as the baffle tile 100 itself. The notch 108 of the retaining structure 106 inserts into the two abutted notches 104 in the tabs 102 to secure them. The legs 110 on either side of the notch 108 in the retaining structure 106 hold the tabs 104 together and keep them from pulling apart.

Figure 5:
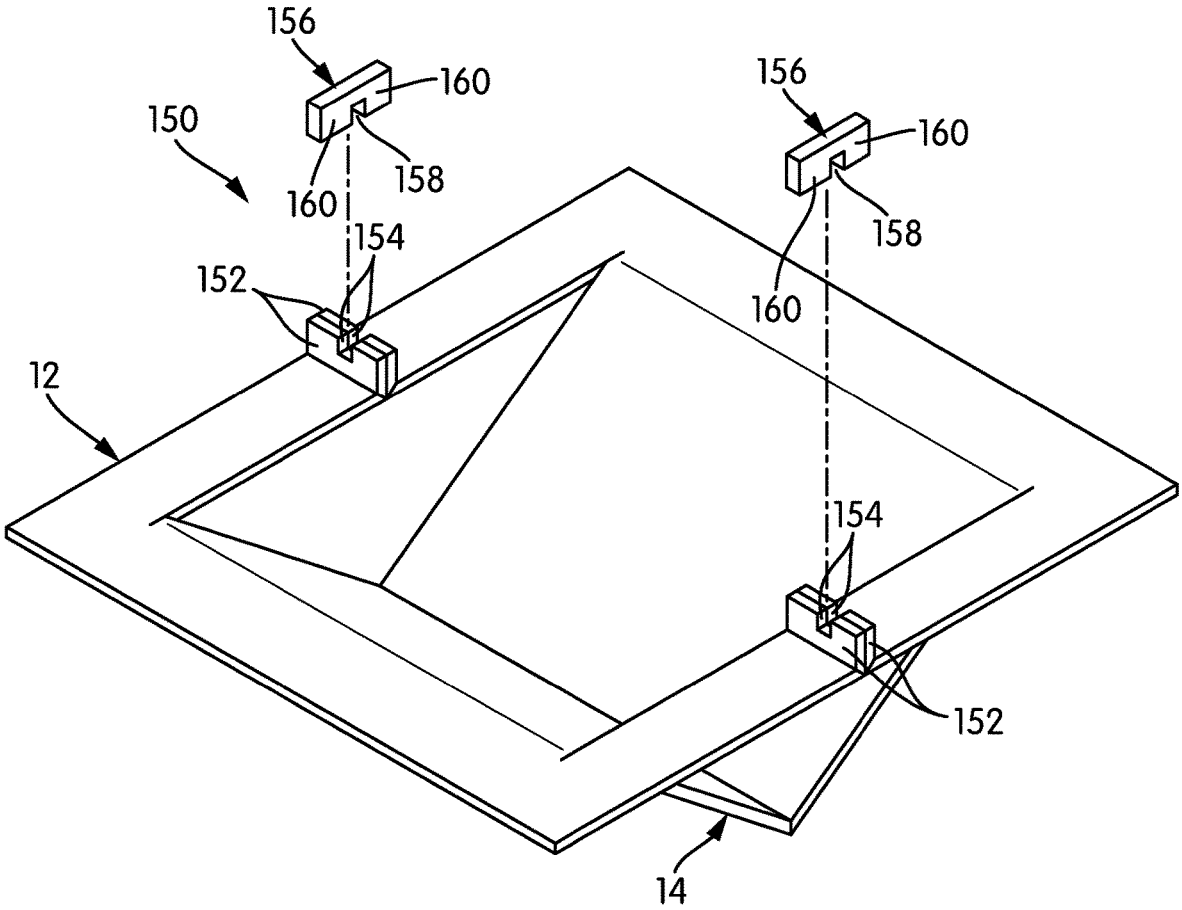
FIG. 5 is an exploded perspective view of a baffle tile according to yet another embodiment of the invention.

FIG. 5 is an exploded perspective view of a baffle tile, generally indicated at 150, according to yet another embodiment of the invention. The baffle tile 150 has a rim 12 and a baffle portion 14 that are generally identical to those shown and described above, although as with other embodiments, that need not always be the case.

The baffle tile 150 has tabs 152 with notches 154 that are oriented vertically, open at a top edge of each tab 152 and extend down about half the height of each tab 152. This is similar to the arrangement in the baffle tile 10 described above. In this case, the retaining structure 156 is different: it has an inverted U-shape with a notch 158 that inserts vertically into the aligned notches 154 of the tabs 152. The legs 160 of the retaining structures 156 sit astride the tabs 152, preventing them from pulling apart.

The arrangements of the tabs 22, 102, 152 and their respective retaining structures 28, 106, 156 are roughly functionally equivalent: all serve to keep the tabs 22, 102, 152 from coming apart, and thus, keep the baffle tile 10, 100, 150 in its three-dimensional configuration. The retaining structures 28, 106, 156 can all be cut from the same material of which the baffle tile 10, 100, 150 itself is made. One consideration that may dictate the selection of the baffle tile 10 over the others in some circumstances is that of visibility: the baffle tile 10 is designed to limit what can be seen from below.

As disclosed above, in each of these embodiments, the baffle tile 10, 100, 150 is open; that is, it is possible to see through the baffle tile 10, 100, 150 from at least some angles because when the baffle or baffles fold down, an opening or openings are created in the plane of the rim. This is why sight lines and visibility are taken into account in some aspects of the design of these baffle tiles 10, 100, 150. That visibility and openness may not be desirable in all embodiments. First, an open baffle tile 10, 100, 150 may allow room occupants to see through the baffle tile 10, 100, 150 into the area above the drop ceiling and may thus negate at least some of the concealing function typically performed by drop ceiling tiles. For functional reasons, it may also be desirable for a baffle tile 10, 100, 150 according to embodiments of the invention to be closed. For example, traditional drop ceiling tiles form a barrier that may prevent the spread of fire, and fire safety codes may require that the ceiling tiles be closed.

Figure 6:
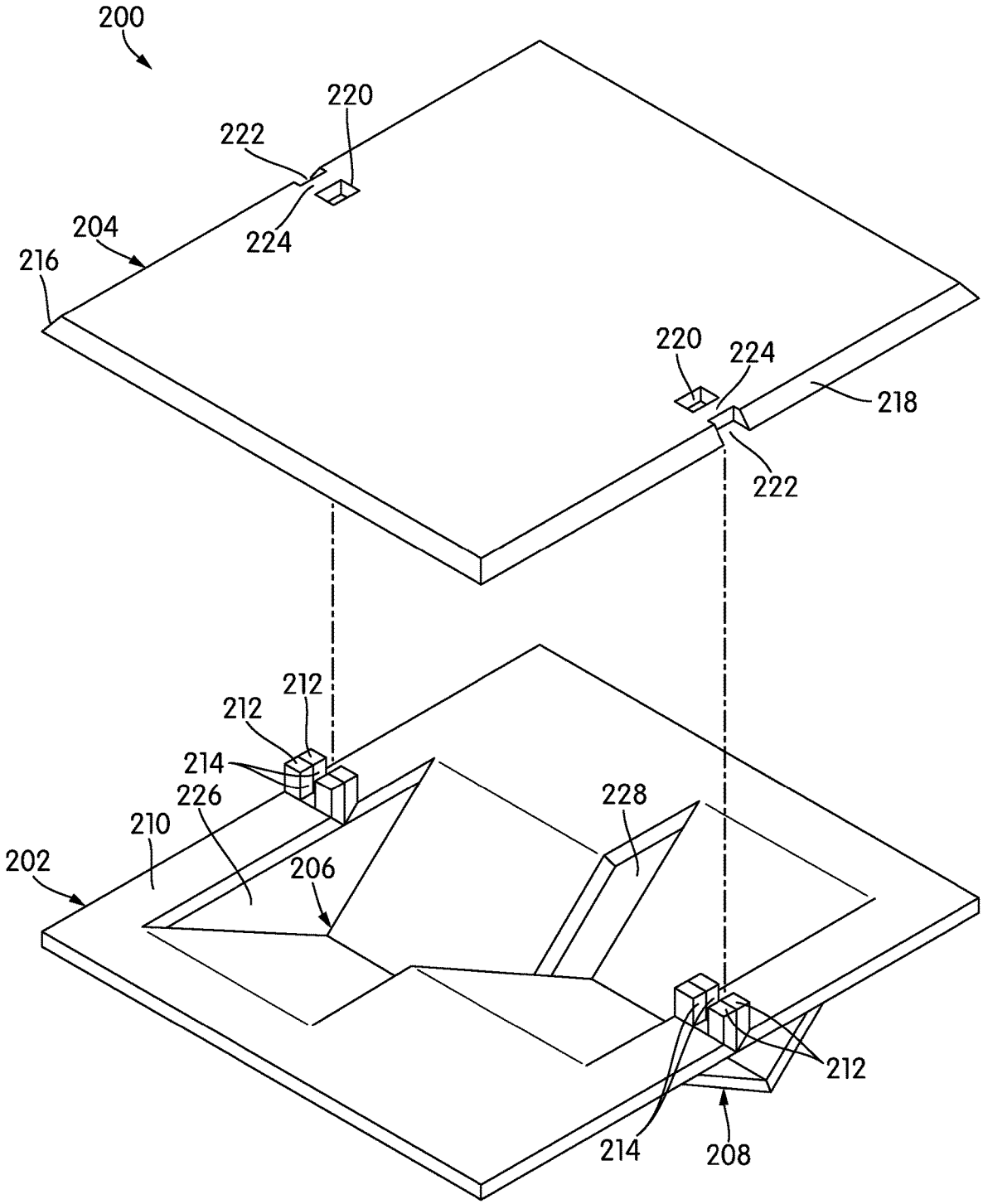
FIG. 6 is an exploded perspective view of a baffle tile according to a further embodiment of the invention.

The same system of tabs 22, 102, 152 and retaining structures 28, 106, 156 can be used, if desired, to cap or close-off a tile. More specifically, FIG. 6 is an exploded perspective view of a baffle tile, generally indicated at 200, according to another embodiment of the invention. The baffle tile 200 of FIG. 6 includes a tile body 202, which is similar to the baffle tiles 10, 100, 150 described above, and a combination retaining structure and cap 204 that fits over the top of the tile body 202 to keep it in its three dimensional configuration and to cap and enclose the tile body 202.

The tile body 202 is similar to the tiles 10, 100, 150 described above, and is also similar to the a "2V" tile disclosed in U.S. patent application Ser. No. 17/181,340, filed Feb. 22, 2021, the contents of which are incorporated by reference herein in their entirety. More specifically, the tile body 202 has two separate baffle portions 206, 208 that are created by sets of shared and separate fold and cut lines, as described elsewhere.

In general, like the baffle tiles 10, 100, 150 described above, the tile body 202 has a rim portion 210 to which the two baffle portions 206, 208 remain connected. The rim portion 210 is in two split halves. On each side of the rim 210, each half of the rim 210 terminates in a folded-up tab 212, with pairs of aligned tabs 212 abutting one another across the transverse centerline of the tile body 202. In other words, the arrangement is much like the arrangement of the other tiles 10, 100, 150 described above.

The tabs 212 themselves are not cut along an incline on their interior-facing sides, as are the tabs 22 described above. This is because, in this embodiment, sightlines are less of a concern. Each tab 212 does, however, have the same kind of notch 214 that opens along a top surface of the tab 212 and extends downwardly. This gives each tab 212 a U-shape.

The retaining structure and cap 204 inserts over the top of the tile body 202. The retaining structure and cap 204 is a piece that is typically made of the same material as the tile body 202, e.g., PET felt, although it may be made of wood or any number of other materials. The shape of the retaining structure and cap 204 is roughly the same as the plan-view shape of the tile body 202 in its three-dimensional configuration. In this embodiment, the tile body 202 is roughly square in its plan-view shape, and the retaining structure and cap 204 has the same overall shape and size. As can be seen in FIG. 6, the side edges 216, 218 of the cap 204 are beveled to limit their thickness, which may be helpful both in inserting the tile 200 into a drop ceiling and for aesthetic reasons.

The retaining structure and cap 204 is adapted to engage the pairs of abutted tabs 212 on the tile body 202. Specifically, on each side, aligned with the positions of the abutted tabs 212, the retaining structure and cap 204 has an opening 220 that is designed to fit over one side of the abutted tabs 212 and a cut-out 222 extending inwardly from the edge of the retaining structure and cap 204 that is designed to accommodate the other side of the abutted tabs 212. This leaves a bridge of material 224 between the opening 220 and the slot 222 which goes through the aligned notches 214 in the tabs 212. The effect is the same as with the tabs 22 and retaining structures 28 described above: the bulk of the retaining structure and cap 204, bearing against the tabs 212, keeps the tabs 212 from separating, and thus, retains the tile body 202 in its three-dimensional configuration.

Figure 7:
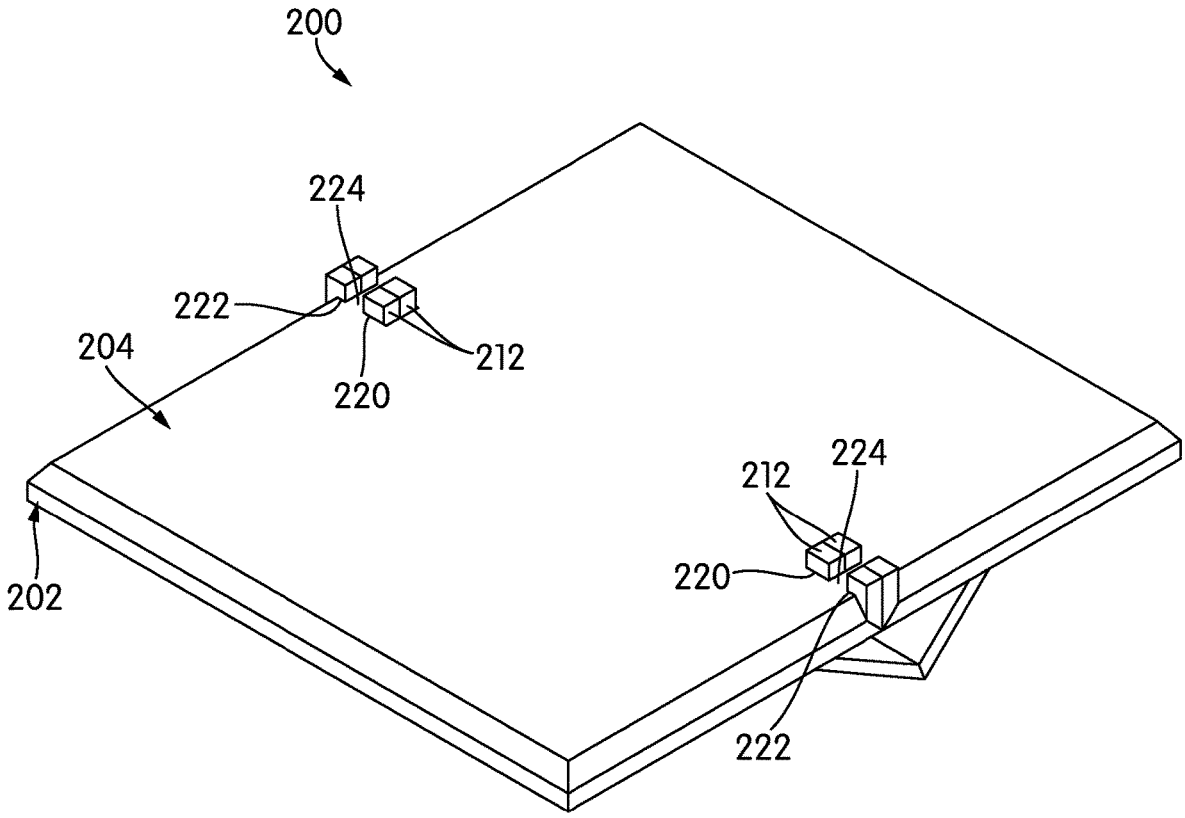
FIG. 7 is a perspective view of the baffle tile of FIG. 6, shown assembled.
Figure 8:
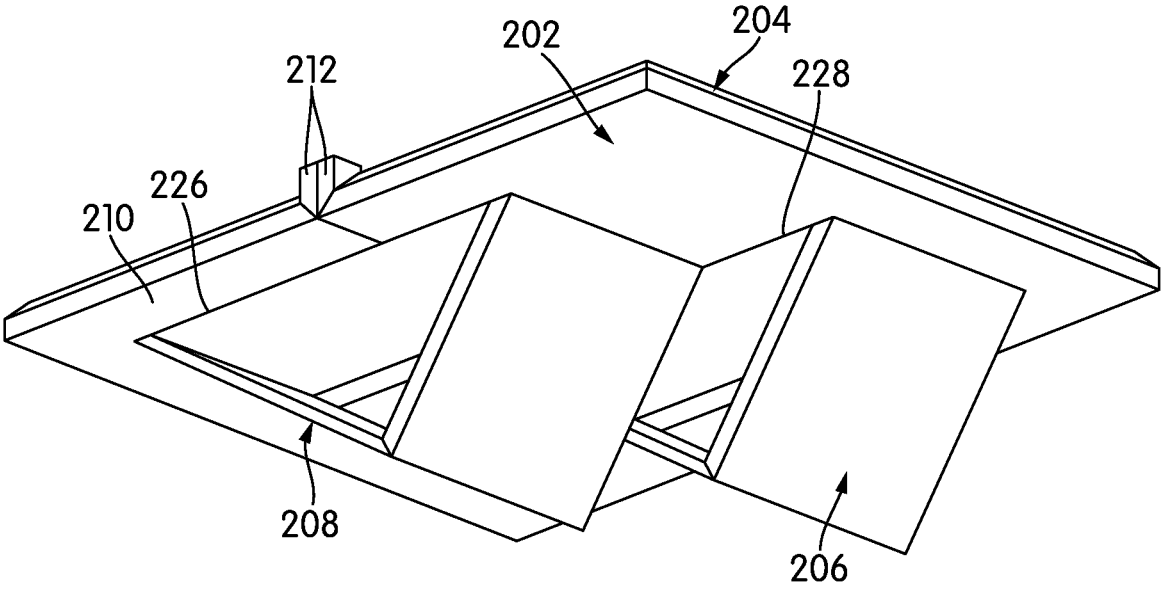
FIG. 8 is an assembled perspective view of the baffle tile of FIG. 6, shown from its underside.

As with other embodiments, the engaging structures 220, 222, 224 of the retaining structure and cap 204 are made to have a tight fit with the tabs 212, so that no tools are needed to install the retaining structure and cap 204 securely. FIG. 7 is a perspective view of the baffle tile 202 in its assembled configuration, with the retaining structure and cap 204 seated in the tabs 212 overtop the tile body 202. As shown in the perspective view of FIG. 8, which illustrates the underside of the tile body 202, when the retaining structure and cap 204 is fully installed on the tile body 202, the openings 226, 228 left by the folding-down of the baffles 206, 208 are closed by the retaining structure and cap 204.

While the invention has been described with respect to certain embodiments, the description is intended to be exemplary, rather than limiting. Modifications and changes may be made within the scope of the invention, which is defined by the appended claims.

What is claimed is:

1. A system, comprising:

a baffle tile for a drop ceiling including at least one depending baffle portion and a rim portion extending in a plane around the baffle portion, the baffle tile having a flat configuration and a three-dimensional configuration established by folding the flat configuration along predefined fold lines to form the baffle portion and the rim portion, the rim portion in the three-dimensional configuration having two halves, each half terminating in a pair of spaced-apart tabs defined, at least in part, by tab fold lines arranged to allow the pair of tabs to fold in a direction opposite the baffle portion, the rim portion arranged such that the pair of tabs in one half of the rim portion abuts the pair of tabs in the other half of the rim portion when the baffle tile is in the three-dimensional configuration, each one of each of the pairs of tabs including a notch that opens at an edge of the tab positioned such that the notches of respective abutted tabs align with one another and open at corresponding, aligned edges of the respective abutted tabs in the three-dimensional configuration of the baffle tile; and a pair of retaining structures adapted to engage the notches of the abutted tabs to prevent the tabs from moving apart.

2. The system of claim 1, wherein the edge of the tab comprises a top edge of the tab.

3. The system of claim 2, wherein each of the pair of retaining structures has a first portion that is essentially the same size as the notches in at least one dimension and second portions on opposite ends of the first portion that are larger than the notches.

4. The system of claim 3, wherein each of the pair of retaining structures has a dog bone shape with an elongate rectangular first portion and second portions that essentially match a width of one of the pair of tabs.

5. The system of claim 3, wherein each of the pair of tabs has an angled edge aligned with an inner edge of the rim portion.

6. The system of claim 5, wherein each of the pair of retaining structures has a beveled edge positioned and angled to be aligned with the angled edge of one of the pair of tabs.

7. The system of claim 2, wherein each of the pair of retaining structures has a downwardly-opening notch that fits into the notches of the abutted tabs and leg portions that sit astride the abutted tabs when the downwardly-opening notch fits into the notches of the abutted tabs.

8. The system of claim 1, wherein the pair of retaining structures forms a tight fit within the notches.

9. The system of claim 1, wherein the edge of the tab comprises a lateral side edge of the tab.

10. The system of claim 9, wherein each of the pair of retaining structures has a notch that engages the notches of one of the pairs of tabs and leg portions that surround the pair of tabs.

11. The system of claim 1, wherein the baffle tile and the pair of retaining structures are formed of the same type and thickness of material.

12. The system of claim 11, wherein the material comprises a felt.

13. The system of claim 12, wherein the felt comprises a polyethylene terephthalate felt.

14. The system of claim 1, wherein the pair of retaining structures can be seated in the notches without the use of tools.

15. A system, comprising:

a baffle tile for a drop ceiling including at least one depending baffle portion and a rim portion extending in a plane around the baffle portion, the baffle tile having a flat configuration and a three-dimensional configuration established by folding the flat configuration along predefined fold lines to form the baffle portion and the rim portion, the rim portion in the three-dimensional configuration having two halves, each half terminating in a pair of spaced-apart tabs defined, at least in part, by tab fold lines arranged to allow the pair of tabs to fold in a direction opposite the baffle portion, the rim portion arranged such that the pair of tabs in one half of the rim portion abuts the pair of tabs in the other half of the rim portion when the baffle tile is in the three-dimensional configuration, each one of each of the pairs of tabs including a notch that opens at an edge of the tab positioned such that the notches of respective abutted tabs align with one another and open at corresponding, aligned edges of the respective abutted tabs in the three-dimensional configuration of the baffle tile; and a retaining structure and cap having substantially the same shape and size as a plan view of the baffle tile in the three-dimensional configuration, the retaining structure and cap having openings therein that fit over and engage the abutted pairs of tabs to retain the baffle tile in the three-dimensional configuration, the retaining structure and cap adapted to cover an upper side of the baffle tile.

16. The system of claim 15, wherein the edge of the tab comprises a top edge of the tab.

17. The system of claim 15, wherein the baffle tile and the pair of retaining structures are formed of the same type and thickness of material.

18. The system of claim 17, wherein the material comprises a felt.

19. The system of claim 18, wherein the felt comprises a polyethylene terephthalate felt.

* * * * *